US008763281B2

(12) United States Patent
Coulombe et al.

(10) Patent No.: US 8,763,281 B2
(45) Date of Patent: Jul. 1, 2014

(54) PLOW

(75) Inventors: Alexandre Coulombe, Saint-Germain de Grantham (CA); Normand Roy, St-Hugues (CA); Marc-Andre Patry, Drummondville (CA); Vincent Morin, Drummondville (CA); Jeremie Aubin-Marchand, St-Hugues (CA); Erick Bienvenue, Sherbrooke (CA); Patrick Hamel, St-Charles-de-Drummond (CA); Jean-Philippe Drouin, Saints-Anges (CA); Nicolas Demers, St-Charles-de-Drummond (CA)

(73) Assignee: Soucy International Inc., Drunnmondville (CA)

( * ) Notice: Subject to any disclaimer, the term of this patent is extended or adjusted under 35 U.S.C. 154(b) by 80 days.

(21) Appl. No.: 13/183,746

(22) Filed: Jul. 15, 2011

(65) Prior Publication Data

US 2012/0186111 A1 Jul. 26, 2012

Related U.S. Application Data

(60) Provisional application No. 61/365,044, filed on Jul. 16, 2010.

(51) Int. Cl.
*E01H 5/04* (2006.01)

(52) U.S. Cl.
USPC ..... 37/266

(58) Field of Classification Search
USPC ..... 37/264, 265, 266, 276, 451; 172/719, 172/772, 811
See application file for complete search history.

(56) References Cited

U.S. PATENT DOCUMENTS

| | | | | | |
|---|---|---|---|---|---|
| 791,726 | A | * | 6/1905 | Schutte | 401/48 |
| 1,114,442 | A | * | 10/1914 | Brodie | 37/269 |
| 1,839,285 | A | * | 1/1932 | Winkie | 294/54.5 |
| 1,922,917 | A | * | 8/1933 | Russell et al. | 172/701.3 |
| 1,937,243 | A | * | 11/1933 | Pearch | 172/753 |
| 1,976,597 | A | * | 10/1934 | Bird | 172/815 |
| 2,460,560 | A | * | 2/1949 | Williams | 37/278 |
| 3,601,210 | A | * | 8/1971 | Stedman et al. | 180/6.7 |
| 3,666,020 | A | * | 5/1972 | Hess | 172/612 |
| 3,795,069 | A | * | 3/1974 | Cheney | 37/219 |
| 3,829,991 | A | * | 8/1974 | Cheney | 37/221 |
| 3,881,261 | A | * | 5/1975 | Lavoie | 37/273 |
| 4,058,173 | A | * | 11/1977 | Carson | 172/701.3 |
| 4,094,543 | A | * | 6/1978 | Fratini | 294/54.5 |
| 4,306,362 | A | * | 12/1981 | Waterman | 37/219 |
| 4,669,206 | A | * | 6/1987 | Yost | 37/285 |
| 4,819,349 | A | * | 4/1989 | Mensch | 37/407 |
| 4,991,662 | A | * | 2/1991 | Caron et al. | 172/701.1 |
| 5,063,695 | A | * | 11/1991 | Briscoe et al. | 37/451 |
| 5,075,985 | A | * | 12/1991 | Mensch | 37/407 |
| 5,224,555 | A | * | 7/1993 | Bain et al. | 172/772.5 |
| 5,729,919 | A | * | 3/1998 | DeBoer | 37/270 |
| 5,778,572 | A | * | 7/1998 | Lukavich et al. | 37/460 |
| 6,003,617 | A | * | 12/1999 | McSweeney et al. | 172/719 |

(Continued)

*Primary Examiner* — Jamie L McGowan
(74) *Attorney, Agent, or Firm* — Brouillette & Partners; Francois Cartier; Robert Brouillette

(57) ABSTRACT

A plow substantially made from polymeric material is generally configured to be used with all-terrain vehicles ("ATV") or other similar vehicles. The design and shape of the plow generally cause the snow to move toward the middle of the plow instead of being pushed out of the snow removal path or toward the sides of the plow.

23 Claims, 6 Drawing Sheets

(56) References Cited

U.S. PATENT DOCUMENTS

| | | | | |
|---|---|---|---|---|
| 6,574,890 | B2 * | 6/2003 | Bateman, Jr. | 37/264 |
| 6,938,701 | B2 * | 9/2005 | Matsumoto et al. | 172/811 |
| D555,175 | S * | 11/2007 | Shapiro et al. | D15/28 |
| 7,467,485 | B2 * | 12/2008 | Lachance et al. | 37/232 |
| 7,631,441 | B2 * | 12/2009 | Hunt | 37/232 |
| 7,685,748 | B1 * | 3/2010 | Anderson | 37/266 |
| 7,810,581 | B2 * | 10/2010 | Matsumoto et al. | 172/811 |
| D629,425 | S * | 12/2010 | Morin | D15/11 |
| 8,291,624 | B2 * | 10/2012 | Hall | 37/266 |
| 2003/0221338 | A1 * | 12/2003 | Verseef | 37/266 |
| 2004/0250454 | A1 * | 12/2004 | Jager | 37/266 |
| 2006/0059727 | A1 * | 3/2006 | Yoder | 37/266 |

* cited by examiner

PLOW

CROSS-REFERENCE TO RELATED APPLICATIONS

The present patent application claims the benefits of priority of commonly assigned U.S. Provisional Patent Application No. 61/365,044, entitled "Plow" and filed at the United States Patent and Trademark Office on Jul. 16, 2010, the content of which is incorporated herein by reference.

FIELD OF THE INVENTION

The present invention generally relates to plows and more particularly to plows for use on All-Terrain Vehicles ("ATVs"), on Utility-Terrain Vehicles ("UTVs") and/or on other similar vehicles.

BACKGROUND OF THE INVENTION

Snow plows that may be installed on and used with all-terrain vehicles (hereinafter "ATV" or "ATVs") and utility-terrain vehicles (hereinafter "UTV" or "UTVs") exist in many shapes. Ears or side plates that may be installed on the sides of existing plows are sold as accessories but none of the existing designs has an integrated shape allowing the plow to push the snow towards the middle of the plow instead of pushing the snow out of the snow removal path.

Also, existing models of plows are typically made from metallic materials. Existing plows also typically use metal parts to hold the wear bars and the blade shoes. In that sense, typical wear bars are also made from metallic materials.

Hence, typical plows for use with ATVs and UTVs are substantially heavy, making them difficult to handle.

Consequently, despite ongoing developments in the field of plows and snow plows, there is still a need for a plow which would obviate at least some of the shortcomings of prior plows.

SUMMARY OF THE INVENTION

A plow in accordance with the principles of the present invention is substantially made from molded polymeric material and generally comprises a main central portion, two side portions located on each side of the central portion, a top portion located at the top of the central portion, and a bottom portion located at the bottom of the central portion.

The central portion, the side portions, and the top portion are generally curved such as to define an inwardly or concave front plow surface which causes the snow, or any other plowed material, to move toward the front and the center of the plow.

A plow in accordance with the principles of the present invention may further comprise a plurality of structural elements or reinforcement ribs that are integrally molded with the plow, typically at the back thereof, such as to provide structural integrity thereto.

A plow in accordance with the principles of the present invention may further comprise a wear bar that is made from polymeric material. The wear bar is typically mounted to the bottom portion of the plow via complementary tongue and groove respectively provided on the bottom portion of the plow and on the wear bar, or vice-versa. The complementary tongue and groove are laterally extending such that the wear bar is typically mounted to the plow by laterally sliding the tongue into the groove.

A plow in accordance with the principles of the present invention will typically push the snow toward the center of the plow, and in front thereof, without the need for additional ears or side plates.

A plow in accordance with the principles of the present invention is also typically lighter than prior art metallic plow and is thus easier to handle.

Other and further aspects and advantages of the present invention will be obvious upon an understanding of the illustrative embodiments about to be described or will be indicated in the appended claims, and various advantages not referred to herein will occur to one skilled in the art upon employment of the invention in practice. The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel plow will be described hereinafter. Although the invention is described in terms of specific illustrative embodiments, it is to be understood that the embodiments described herein are by way of example only and that the scope of the invention is not intended to be limited thereby.

Figure 1:
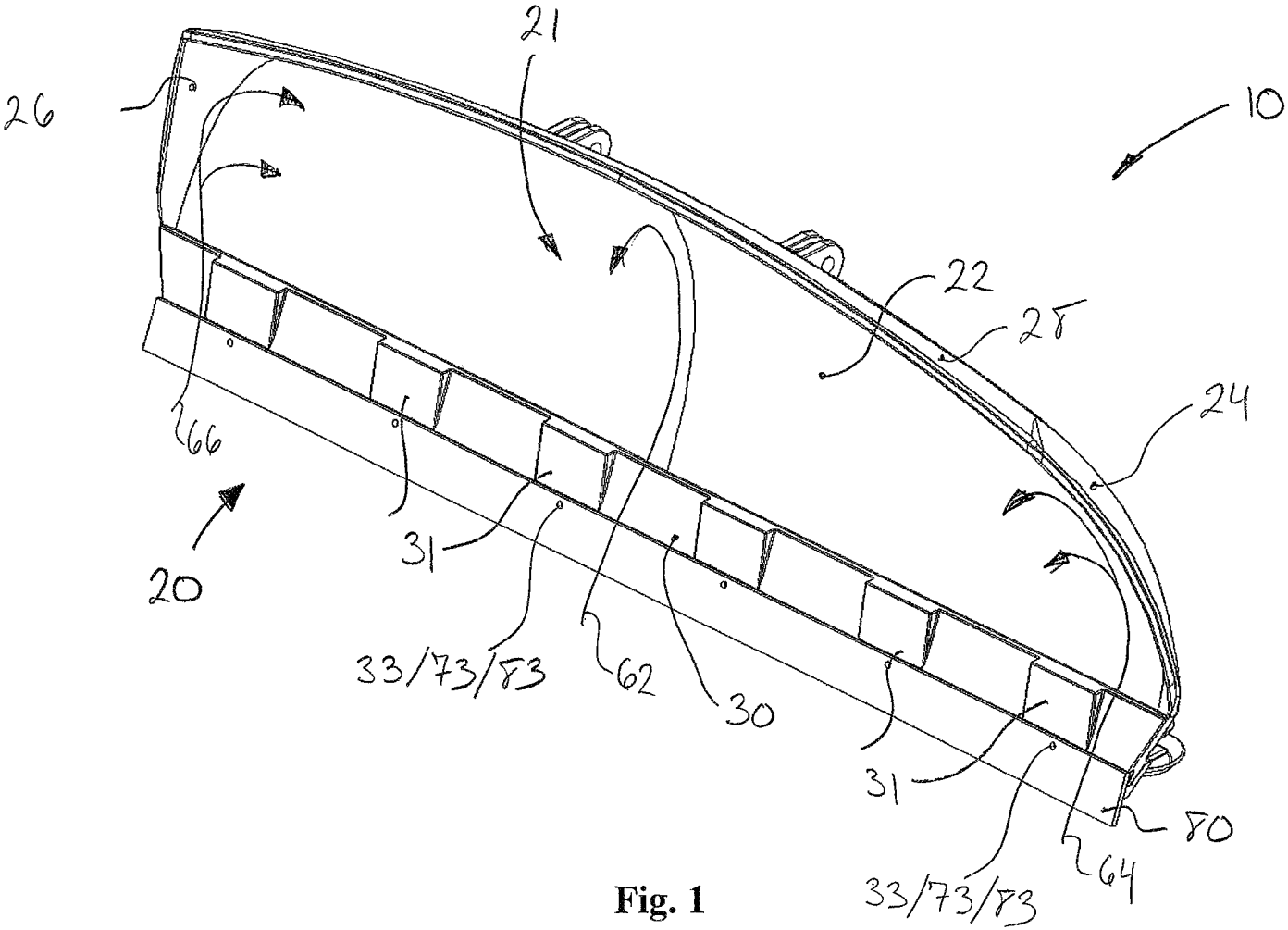
FIG. 1 is front perspective view of the plow.

Referring first to FIG. 1, a plow 10 in accordance with the principles of the present invention is typically configured to push and/or roll snow, or any other plowable material, in front of the plow 10 and to move the snow from the sides of the plow 10 toward the center of the plow 10 instead of moving the snow from the center toward the sides. Hence, the configuration of the plow 10 is generally designed to limit the snow leaving the plow 10 without the need to have or add supplementary ears or side panels.

In the present embodiment, the plow 10 is made from polymeric material, such as, but not limited to, ultra high molecular weight ("UHMW") polyethylene. The plow 10 is also typically molded in one piece. Preferably, but not necessarily, the plow 10 is made by compression molding.

Figure 3:
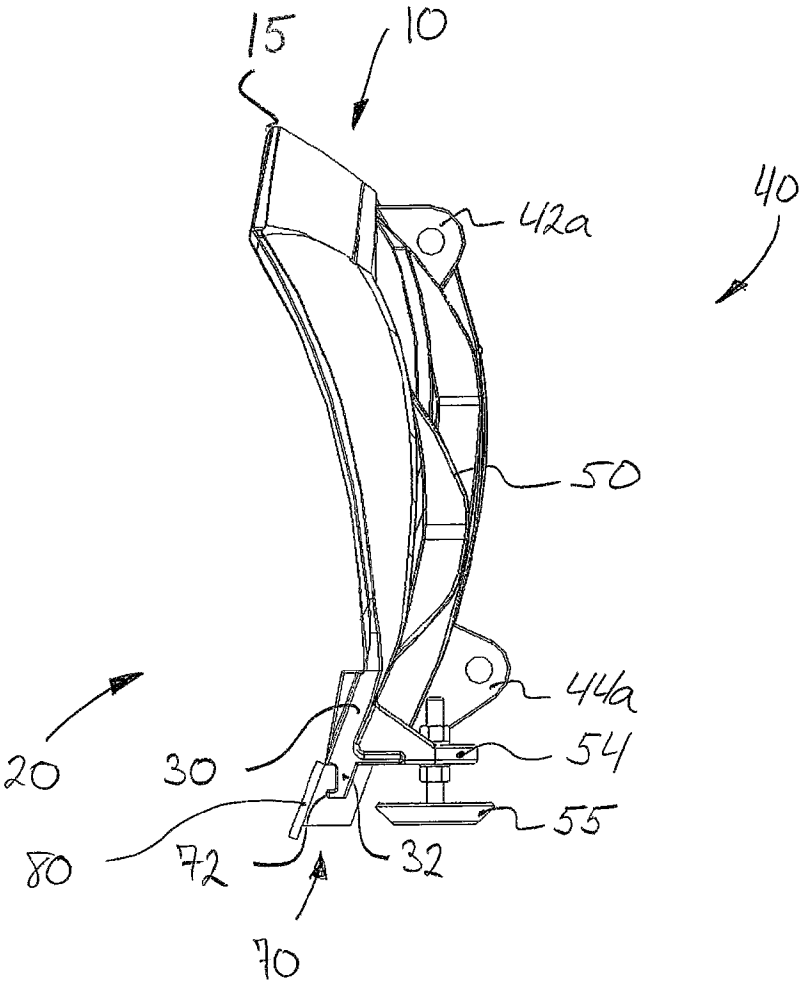
FIG. 3 is a left side view of the plow.

Referring to FIGS. 1 and 3, the plow 10 typically comprises a main body 15 having a front or front region 20 configured to engage and plow the snow, and a back or rear region 40 configured to be mounted to a vehicle, typically via an appropriate support frame assembly, not shown.

Figure 2:
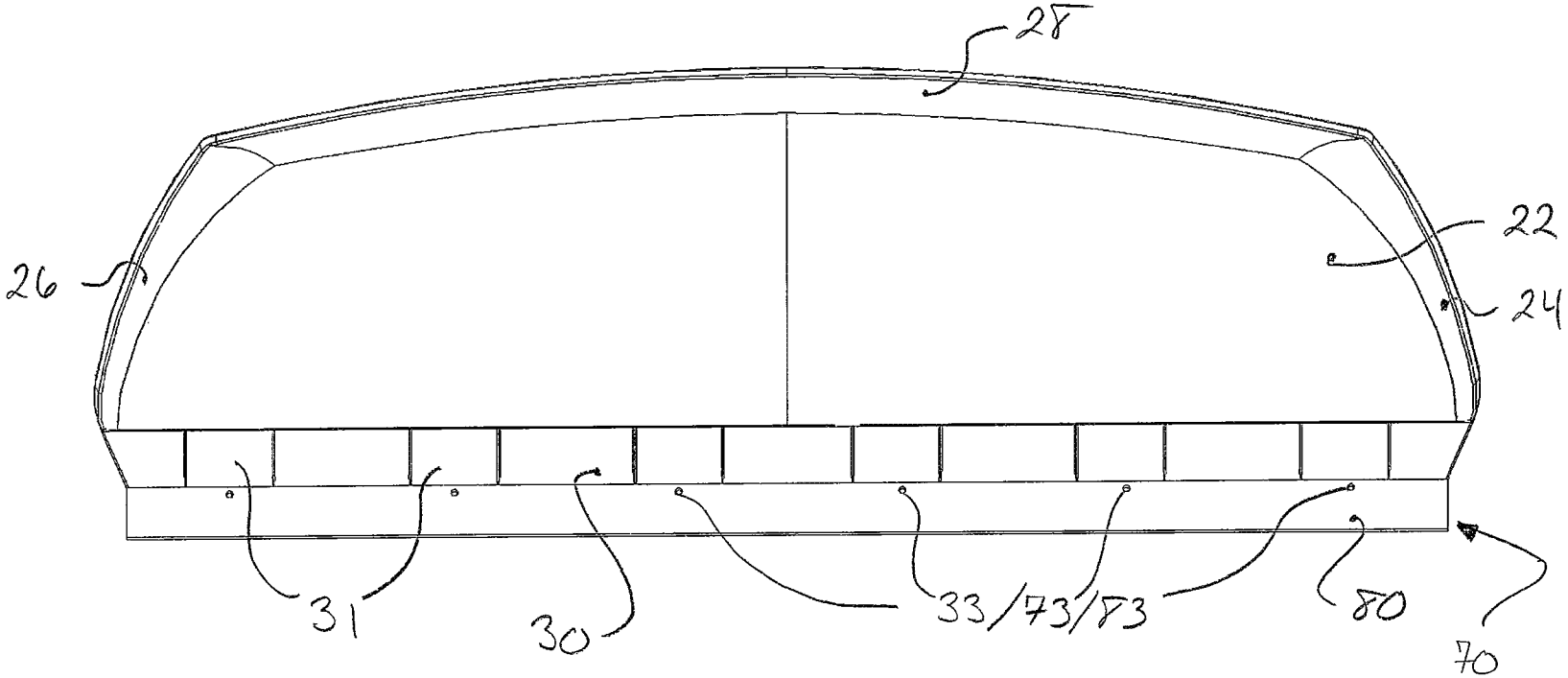
FIG. 2 is a front view of the plow.

Referring to FIGS. 1, 2 and 3, the front 20 the plow 10 comprises a laterally extending central portion 22, side portions 24 and 26 located on each side of the central portion 22, a top portion 28 located at the top of the central portion 22 and laterally extending between the two side portions 24 and 26, and a laterally extending bottom portion 30 located at the bottom of the central portion 22. The central portion 22 is typically slightly inwardly curved whereas the side portions 24 and 26 and the top portion 28 are typically outwardly arcuate or curved.

In the present embodiment, the central portion 22, the side portions 24 and 26, the top portion 28, and the bottom portion 30 are integrally molded.

As best illustrated in FIGS. 1, 2 and 3, the central portion 22, the side portions 24 and 26 and the top portion 28 generally define an inwardly concave front plow surface 21. During operation of the plow 10, it is generally the front plow surface 21 that will engage the snow to be plowed.

In that sense, FIG. 1 illustrates schematically the typical movements imparted to the snow under the action of the front plow surface 21 defined by the central portion 22, the side portions 24 and 26, and the top portion 28 when the plow 10 is positioned substantially transversally with respect to the direction of operation of the vehicle to which the plow 10 is mounted. In that position, when the plow 10 is actively pushing and plowing snow, the side portions 24 and 26 will cause the snow to move slightly upwardly and then toward the center of the plow 10 as illustrated by the arrows 64 and 66. For its part, the central portion 22 and the top portion 28 will generally cause the snow to return or roll toward the front of the plow 10 as illustrated by the arrow 62.

The movements imparted to the snow by the plow 10 generally prevent snow from leaving the plow 10 as the snow is pushed forwardly toward the center of the plow 10. However, it is to be understood that the movements imparted to the snow may vary if the plow 10 is operated at an angle (i.e. not substantially transversally) with respect to the direction of operation of the vehicle to which the plow 10 is mounted.

In the present embodiment, the side portions 24 and 26 and the top portion 28 extend sufficiently forwardly from the central portion 22 to cause the snow to be displaced toward the center and the front of the plow 10 as indicated by the arrows 62, 64 and 66.

Still referring to FIGS. 1, 2 and 3, in the present embodiment, the bottom portion 30 of the front 20 of the plow 10 displays a series of laterally spaced apart teeth or protuberances 31 and a downwardly extending tongue 32 which also extends laterally along the width of the bottom portion 30.

The teeth 31 generally serve to break apart the snow in order to make it roll in smaller portions instead of a larger amount stuck together. In that sense, the teeth 31 generally cut the snow in bands of a certain width before rolling it.

The downwardly extending tongue 32 is configured to be slidingly received into the complementary groove 72 of a wear bar 70.

In that sense, since the wear bar 70 is a wear structure which is subjected to regular replacement, the wear bar 70 is typically not integrally molded with the plow 10.

In the present embodiment, the tongue 32 has a hook profile that retains the wear bar 70 on the bottom portion 30. Hence, as best illustrated in FIG. 3, the tongue 32 typically comprises a first portion downwardly extending from the bottom portion 30 and a second portion extending forwardly at angle from the first portion. It is to be noted that the shapes of the tongue 32 and of the groove 72 may vary and is not limited to the shapes illustrated in the figures. For example, the tongue 32 and the groove 72 may have an inverted 'T' shape or any other shape allowing the bottom portion 30 to properly retain the wear bar 70. In addition, though in the present embodiment the tongue 32 is located on the plow 10 and the groove 72 is located on the wear bar 70, in other embodiments, the groove could located on the plow 10 and the tongue could located on the wear bar 70.

To prevent the wear bar 70 from laterally sliding out of the tongue 32, and to allow the replacement of the wear bar 70, the tongue 32 and the wear bar 70 are respectively provided with openings 33 and 73 configured to receive fasteners such as, but not limited to, bolts and nuts, screws, pins, etc. (not shown) in order to releasably secure the wear bar 70 to the tongue 32. Understandably, openings 33 and 73 are configured and disposed such as to be in alignment when the wear bar 70 is properly mounted to the tongue 32.

The wear bar 70 according to the present embodiment is made from a polymeric (or plastic) extrusion instead of a piece of plastic sheet or of metal as usually seen in prior art. In the present embodiment, the wear bar 70 is made from UHMW polyethylene.

Since the wear bar 70 is a wear structure, it can be further provided with a metallic scraping blade 80 as best illustrated in FIG. 3. The scraping blade 80 is typically used as a more durable wear structure and to improve the scraping action of the plow 10.

The scraping blade 80 can either be releasably mounted to the wear bar 70 via fasteners and openings 83 (typically aligned with openings 33 and 73), or be fixedly mounted to the wear bar 70 by glue or adhesive.

In the present embodiment, the scraping blade 80 is releasably mounted to the wear bar 70 via fasteners and the openings 83.

Notably, in other embodiments, the scraping blade 80 could be directly releasably mounted to the plow 10, i.e. without a wear bar 70.

In the present embodiment, the scraping blade 80 is made of steel though other metallic or similarly resistant materials could also be used.

Figure 4:
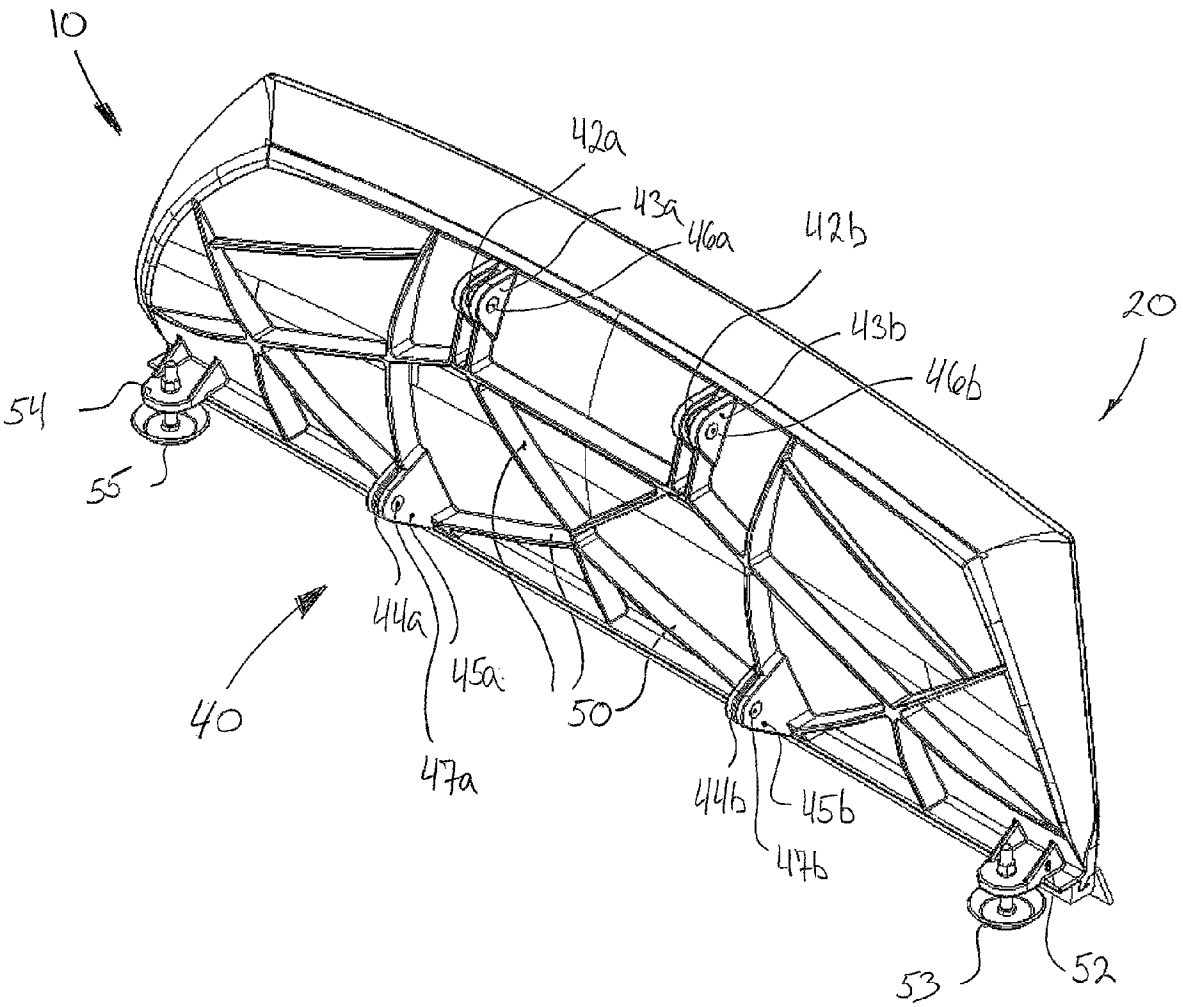
FIG. 4 is a rear perspective view of the plow.
Figure 5:
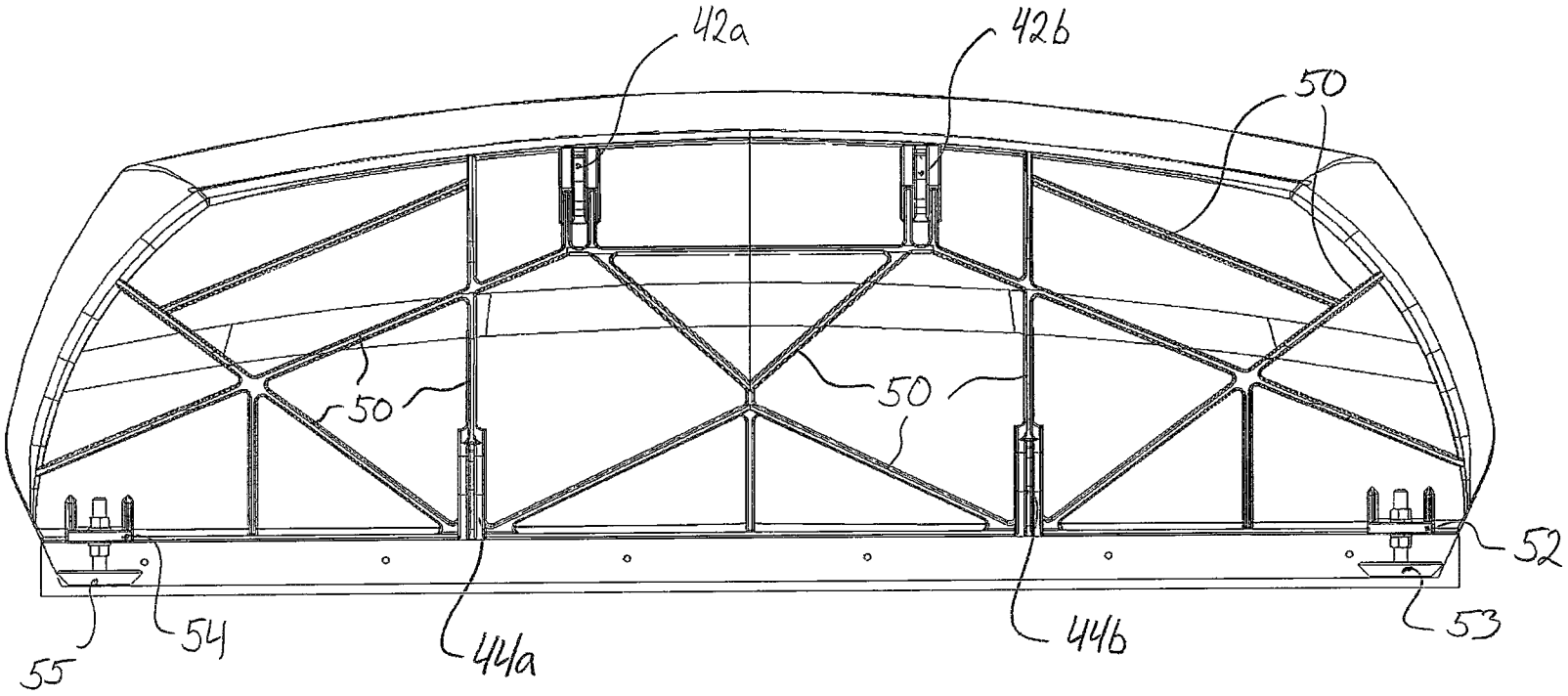
FIG. 5 is a rear view of the plow.
Figure 6:
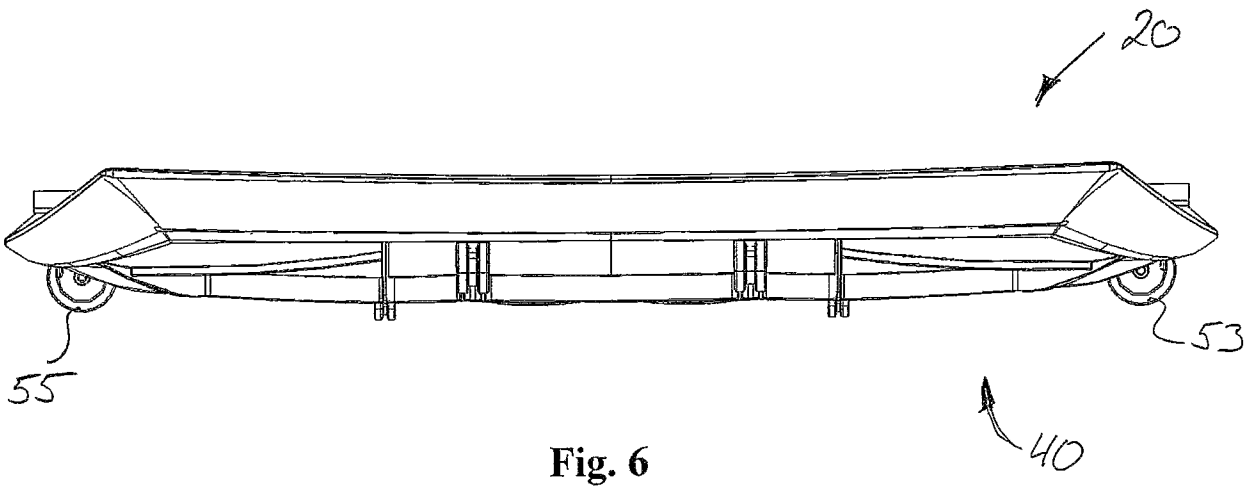
FIG. 6 is a top view of the plow.
Figure 7:
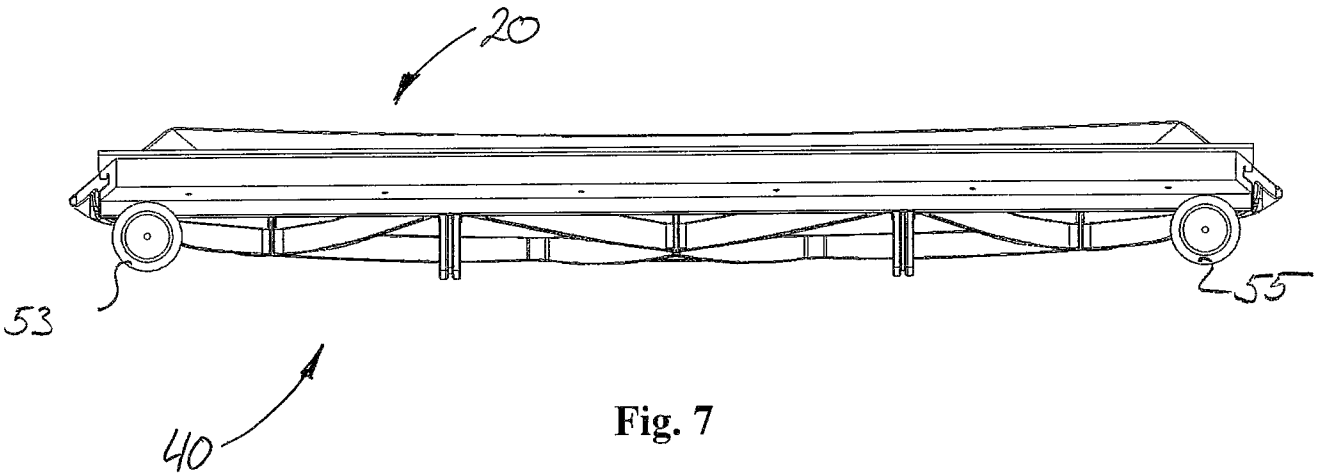
FIG. 7 is a bottom view of the plow.

Referring now to FIGS. 4 and 5, the back 40 of the plow 10 comprises upper mounting points 42*a* and 42*b* and lower mounting points 44*a* and 44*b*. These mounting points 42 and 44 are configured to mount the plow 10 to a vehicle (e.g. ATV, UTV, etc.), typically via an appropriate support frame assembly (not shown). In the present embodiment, the mounting points 42 and 44 are integrally molded (i.e. molded unitarily) with the plow 10, so there is no need to use an additional subframe to attach the plow 10 to the support frame assembly coupled to the vehicle.

The mounting points 42*a* and 42*b* and 44*a* and 44*b* are respectively located on protrusions 43*a* and 43*b* and protrusions 45*a* and 45*b*. The protrusions 43*a* and 43*b* and the protrusions 45*a* and 45*b* are further respectively provided with openings 46*a* and 46*b* and openings 47*a* and 47*b* extending therethrough.

It is to be noted that the shape of the mounting points is not limited to the particular shape shown in the present figures.

The mounting points 42*a* and 42*b* and 44*a* and 44*b* typically comprise metal inserts or bushings (not shown) which are inserted in the openings 46*a* and 46*b* and 47*a* and 47*b*. The metal inserts are used to reinforce and protect the mounting points from the stresses generated at these locations.

Still referring to FIGS. 4 and 5, the back 40 of the plow 10 also comprises a network of interconnected reinforcement members or ribs 50 which are integrally molded with the body 15 of the plow 10. The reinforcement members 50 are consequently made of polymeric material (e.g. UHMW polyethylene).

In the present embodiment, the reinforcement members 50 do not comprise any additional metallic reinforcement.

The configuration of the reinforcement members 50 is designed to provide structural strength to the plow 10. In that sense, the exact configuration of the reinforcement members 50 may change according to the exact shape and configuration of the plow 10. The reinforcement members 50 also help to preserve the overall shape of the plow 10 during the cooling of the plow 10 following the molding thereof. The reinforcement members 50 therefore generally lower the risk of deformation and shrinking after molding.

As best shown in FIGS. 4 and 5, in the present embodiment, the mounting points 42*a*, 42*b* and 44*a*, 44*b* are interconnected with the network of reinforcement members 50. This interconnection between the mounting points 42*a*, 42*b* and 44*a*, 44*b* and the reinforcement members 50 provides some reinforcement to the mountings points and allows the stress applied at the mounting points to be distributed over the plow 10 as in a truss.

Referring to FIGS. 3, 4 and 5, in the present embodiment, the plow 10 also comprises shoe mounting points 52 and 54 configured to receive and support shoes 53 and 55 which are commonly used to control the height of the plow 10 relatively to the ground and to at least partially support the plow 10 on the ground. The height of the plow 10 with respect to the ground may be adjusted with these shoes 53 and 55. The shoe mounting points 52 and 54 are integrally molded (i.e. molded unitarily) with the plow 10. As for the mounting points 42 and 44, the shoe mounting points 52 and 54 can be provided with metallic inserts for additional strength.

Is it to be understood that the disposition and the configuration of the mounting points 42, 44, 52 and 54 may vary according to different models of vehicles (e.g. ATV, UTV, etc.) and/or according to different models of plow-supporting frame assemblies.

The skilled addressee will understand that the plow 10 is configured to be mounted to an ATV, a UTV, or any similar vehicle, via a proper frame assembly.

In use, the plow 10, in addition to being lighter via the use of polymeric material, will typically impart movements to the snow that will typically limit the amount of snow leaving the snow removal path.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A plow for displacing plowable material, the plow comprising a body substantially made from polymeric material, the body comprising a laterally extending central portion, a first side portion extending laterally and forwardly from a first side of the central portion, a second side portion extending laterally and forwardly from a second side of the central portion, a top portion extending upwardly and forwardly from a top side of the central portion and extending laterally between the first and second side portions, and a bottom portion extending downwardly and laterally along a bottom side of the central portion, the body having a front side and a rear side, the front side of the central portion, the first and second side portions and the top portion defining a substantially concave front plow surface, the rear side of the central portion comprising a plurality of mounting locations and a plurality of interconnected reinforcing members, the plurality of mounting locations and the plurality of interconnected reinforcing members being made from polymeric material and being integral with the rear side of the body of the plow, the plurality of mounting locations being interconnected by at least some of the plurality of interconnected reinforcing members.

2. A plow as claimed in claim 1, wherein the front side of the bottom portion comprises a plurality of protuberances.

3. A plow as claimed in claim 2, wherein the plurality of protuberances are laterally spaced apart.

4. A plow as claimed in claim 1, wherein the front plow surface is inwardly curved.

5. A plow as claimed in claim 1, wherein the central portion is inwardly curved.

6. A plow as claimed in claim 5, wherein the top portion is curved.

7. A plow as claimed in claim 6, wherein the side portions are curved.

8. A plow as claimed in claim 1, further comprising a wear bar coupled to the bottom portion.

9. A plow as claimed in claim 8, wherein the wear bar is coupled to the bottom portion via complementary tongue and groove.

10. A plow as claimed in claim 9, wherein the complementary tongue and groove are laterally extending.

11. A plow as claimed in claim 1, wherein the body of the plow is integrally molded.

12. A plow for displacing plowable material, the plow being configured to be mounted to a vehicle, the plow comprising a body substantially made from polymeric material, the body comprising a laterally extending central portion, a first side portion extending laterally and forwardly from a first side of the central portion, a second side portion extending laterally and forwardly from a second side of the central portion, a top portion extending upwardly and forwardly from a top side of the central portion and extending laterally between the first and second side portions, and a bottom portion extending downwardly and laterally along a bottom side of the central portion, the body having a front side and a rear side, the front side of the central portion, the first and second side portions and the top portion defining a substantially concave front plow surface which is configured to impart movements to a plowed material such that the plowed material moves substantially toward the center of the plow and in front thereof when the plow is positioned substantially transversally of a direction of travel of the vehicle to which the plow is mounted, the rear side of the central portion comprising a plurality of mounting locations and a plurality of interconnected reinforcing members, the plurality of mounting locations and the plurality of interconnected reinforcing members being made from polymeric material and being integral with the rear side of the central portion of the body of the plow, the plurality of mounting locations being interconnected by at least some of the plurality of interconnected reinforcing members.

13. A plow as claimed in claim 12, wherein the front side of the bottom portion comprises a plurality of protuberances.

14. A plow as claimed in claim 13, wherein the plurality of protuberances are laterally spaced apart.

15. A plow as claimed in claim 12, wherein the front plow surface is inwardly curved.

16. A plow as claimed in claim 12, wherein the central portion is inwardly curved.

17. A plow as claimed in claim 16 wherein the top portion is curved.

18. A plow as claimed in claim 17, wherein the side portions are curved.

19. A plow as claimed in claim 12, further comprising a wear bar coupled to the bottom portion.

20. A plow as claimed in claim 19, wherein the wear bar is coupled to the bottom portion via complementary tongue and groove.

21. A plow as claimed in claim 20, wherein the complementary tongue and groove are laterally extending.

22. A plow as claimed in claim 12, wherein the body of the plow is integrally molded.

23. A plow as claimed in claim 12, wherein the vehicle is an all-terrain vehicle (ATV) or a utility-terrain vehicle (UTV).

* * * * *